United States Patent [19]

Strout

[11] 4,389,868

[45] Jun. 28, 1983

[54] APPARATUS FOR SHEARING AND COILING STRIP MATERIAL

[75] Inventor: Robert B. Strout, Pembroke, Mass.

[73] Assignee: The Gillette Company, Boston, Mass.

[21] Appl. No.: 291,771

[22] Filed: Aug. 10, 1981

Related U.S. Application Data

[63] Continuation-in-part of Ser. No. 135,795, Mar. 31, 1980, abandoned.

[51] Int. Cl.[3] ..... B21C 47/10; B65H 19/28

[52] U.S. Cl. ..... 72/132; 72/148; 83/150; 83/163; 242/56 R

[58] Field of Search ..... 72/132, 148, 129; 242/56 A, 56 R; 83/150, 163

[56] References Cited

U.S. PATENT DOCUMENTS

| | | | |
|---|---|---|---|
| 1,064,009 | 6/1913 | Robertson et al. | 83/583 |
| 1,882,403 | 10/1932 | Maxson | 83/150 |
| 2,325,504 | 7/1943 | Goins | 72/148 |
| 3,328,991 | 7/1967 | Petros | 72/148 |
| 3,345,009 | 10/1967 | Rockstrom | 242/56 A |
| 3,425,252 | 2/1969 | Dehaine et al. | 72/148 |
| 3,501,104 | 3/1970 | Hellemans | 242/56 A |
| 3,844,189 | 10/1974 | Jardine | 242/56 A X |
| 3,871,595 | 3/1975 | Smolderen | 242/56 A |
| 4,114,491 | 9/1978 | Hashimoto et al. | 83/583 X |

*Primary Examiner*—Frank T. Yost

*Attorney, Agent, or Firm*—Scott R. Foster

[57] ABSTRACT

Apparatus for shearing and coiling strip material, the apparatus including a rotatable mandrel adapted to receive strip material thereon, a first cutter in fixed position proximate the mandrel, and a second cutter removed from the mandrel in a first position but movable to a second position adjacent the first cutter to effect a cutting operation, the first and second cutters having, respectively, first and second guide surfaces which, when the second cutter is in the second position, form a substantially continuous entry surface adapted to urge a cut end of the strip material into engagement with the mandrel.

3 Claims, 8 Drawing Figures

APPARATUS FOR SHEARING AND COILING STRIP MATERIAL

CROSS-REFERENCE TO RELATED APPLICATION

This is a continuation-in-part of abandoned application Ser. No. 135,795, filed Mar. 31, 1980 in the name of Robert B. Strout.

BACKGROUND OF THE INVENTION

1. Field of the Invention

The invention relates to apparatus for shearing and coiling strip material and is directed more particularly to such apparatus in which the shearing means, when in the shearing position, forms guide means for directing the cut strip onto a mandrel.

2. Description of the Prior Art

Methods and apparatus for producing and coiling strip material are well known in the art. For example, metal strip has been produced by peeling a surface layer from a rotating cylindrical metal billet with a cutting tool while simultaneously pulling the formed metal strip over the tool. A leading edge of the metal strip is usually attached by a clamp to a rotating mandrel which supplies pulling force and winds the strip into a coil convenient for handling and shipping. Other means for attaching the strip to the mandrel have included a conventional belt wrapper adapted to selectively move toward and away from the mandrel and pinch the strip between the mandrel and the belt.

Sometimes the shape of the strip initially peeled without tension is not desirable and several adjustments to the peeling apparatus may be needed before the desired strip shape is achieved. The shape of the strip can affect the tightness of the wrap. Thus, initially peeled strip material, distorted due to the absence of tension on the strip during the initiation of the peeling process, is usually sheared and discarded before the wrapping or coiling procedure begins. In known peeling apparatus, the shearing takes place a considerable distance from the coiling mandrel and the strip is guided into position, in the case of a belt wrapper assembly, between the mandrel and the belt. Means for guiding the peeled strip over long distances to the coiling mandrel are complicated and unsatisfactory, particularly when the peeled strip has a tendency to curl, and becomes tangled before it reaches the coiling mandrel.

Accordingly, an apparatus is needed to shear and coil strip material substantially simultaneously, to overcome prior problems of curled strip material, tangled strip material, and loosely wrapped coils.

SUMMARY OF THE INVENTION

It is, therefore, an object of the present invention to provide an apparatus for shearing and coiling strip material, the coiling operation following the shearing operation virtually instantaneously.

With the above and other object in view, as well hereinafter appear, a feature of the present invention is the provision of apparatus for shearing and coiling strip material, the apparatus comprising a mandrel rotatable about its axis and adapted to receive the strip material on a peripheral portion thereof, first cutter means disposed proximate the mandrel in a fixed position, the first cutter means having a first guide surface thereon, and second cutter means having a first position further removed from the mandrel than the first cutter means, the second cutter means being movable to a second position adjacent the first cutter means to effect a cutting operation, the second cutter means having a second guide surface thereon, the first and second guide surfaces forming a substantially continuous entry surface when the second cutting means is in the second position, the entry surface being adapted to urge a cut end of the strip material into engagement with the peripheral portion of said mandrel.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
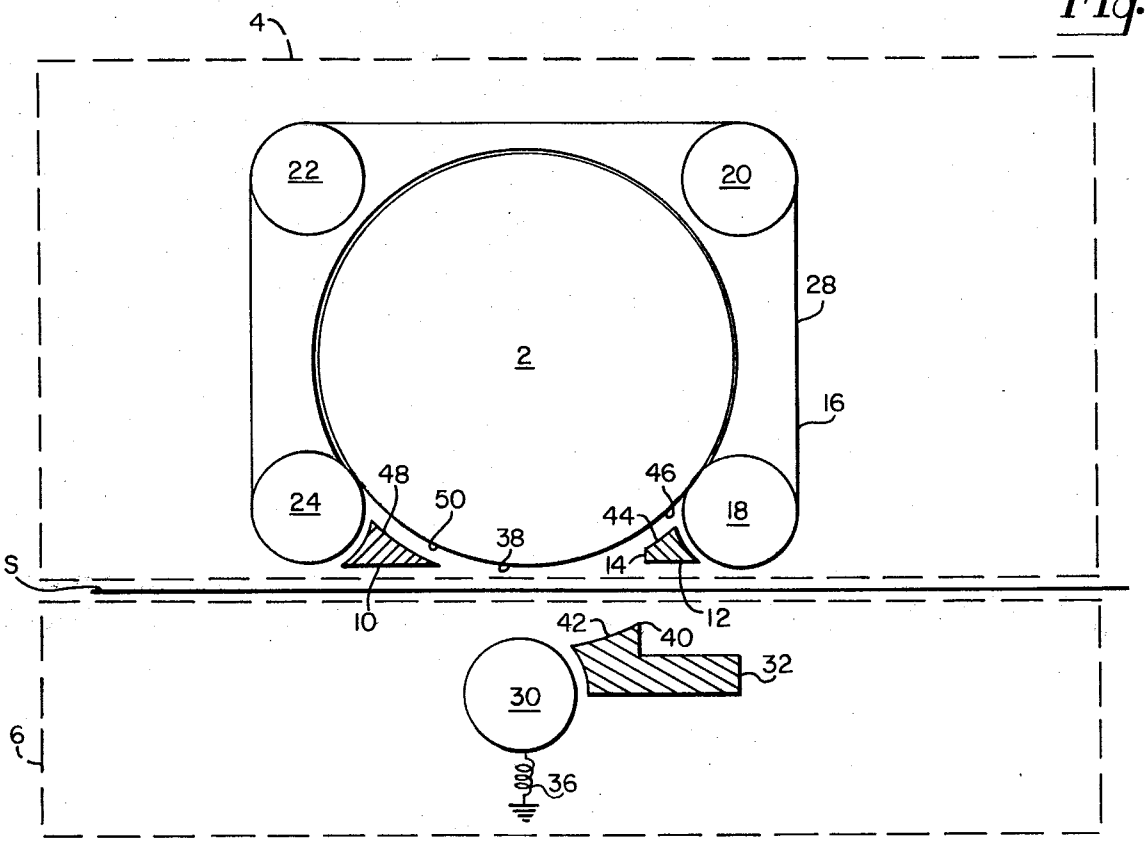
FIG. 1 is a schematic diagram of one form of apparatus for shearing and coiling strip material and illustrative of an embodiment of the invention.

Referring to the drawings, there will be seen (schematically in FIGS. 1–3) an apparatus for shearing and coiling strip material S, such as metal, around a cylindrical coiler, or mandrel 2, adapted to be rotated upon its axis by a motor (not shown). The apparatus includes a belt wrapper assembly 4 and a movable lower shear blade assembly 6. The blade assembly 6 is attached to a reciprocally movable mount 8 (FIGS. 4–6 and 8). The belt wrapper assembly 4 includes a strip guide 10 (FIGS. 1–3), a first shear blade 12 having a cutting edge 14, and a continuous belt 16 looped around a plurality of rollers 18, 20, 22 and 24. The strip guide 10 and the rollers 18, 20, 22 and 24 are arranged on a mounting means 26 so that an outside surface 28 of the belt 16 may be wrapped in tension around the mandrel 2, with the strip guide 10 on one side and the first shear blade 12 on an opposite side of the mandrel, whereby the rotating mandrel 2 moves the belt 16 around the rollers 18, 20, 22 and 24.

The shear blade assembly 6 comprises a pinch drive roller 30 (FIGS. 6 and 8) and a second shear blade 32 cooperatively assembled on a mounting 34 (FIG. 8), with bias means, such as a coil spring 36, arranged to urge the pinch drive roller 30 toward an uncovered portion 38 (FIG. 1) of the mandrel 2, and a cutting edge 40 of the second shear blade 32 to slide past the cutting edge 14 of the first shear blade 12.

Figure 2:
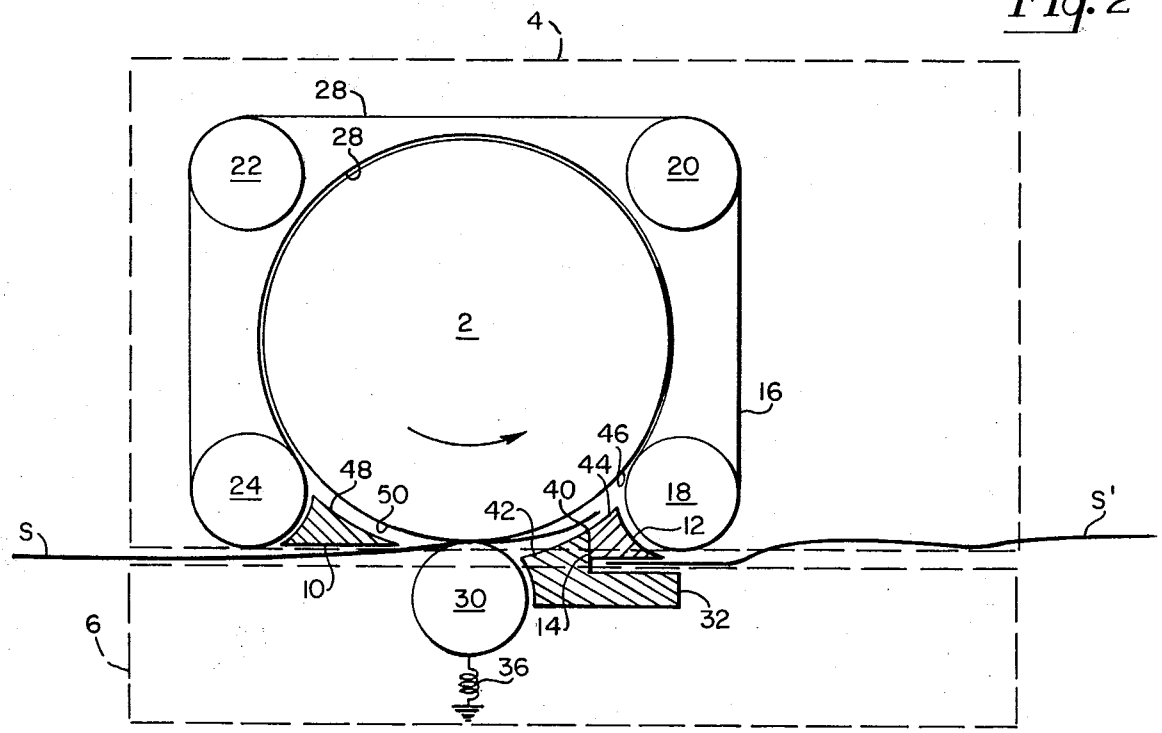
FIG. 2 is a schematic diagram of the apparatus of FIG. 1 in a position for shearing strip material.

Under operating conditions, the moving strip of material S is passed between the motor driven mandrel 2 and the lower shear blade assembly 32, as shown in FIG. 1. The bias means 36 is operable to urge the pinch drive roller 30 against the strip material S, squeezing it against the exposed surface 38 of the rotating mandrel 2. Simultaneously, the bias means 36 causes the cutting edge 40 of the lower shear blade 32 to slide past the cutting edge 14 of the upper shear blade 12 to shear a section S' from the strip material, as shown in FIG. 2. Complementary curved surfaces 42, 44 of the lower and upper shear blades 32, 12, respectively, form a second strip guide for immediately directing the remaining strip material S toward the similarly curved surface 46 (FIGS. 1 and 2) of the mandrel 2 for coiling. The pinch drive roller 30 and the lower shear blade 32 may be cooperatively arranged so that the pinch drive roller 30 acts as a means for smoothly merging the curved surface 42 of the lower shear blade 32 with the curved surface 44 of the upper shear blade 12 to form the second strip guide, after shearing of the strip material is completed. Thus, coiling of the strip material S around the mandrel 2 begins substantially simultaneously with shearing, to avoid twisting of the strip material S. The strip material S is pushed between the outside belt surface 28 and the mandrel 2 by the rotating pinch drive roller 30, where it is caught and pulled around the mandrel 2 and between a curved surface 48 of the first strip guide 10 and a similarly curved mandrel surface 50 (FIGS. 1 and 2).

Figure 3:
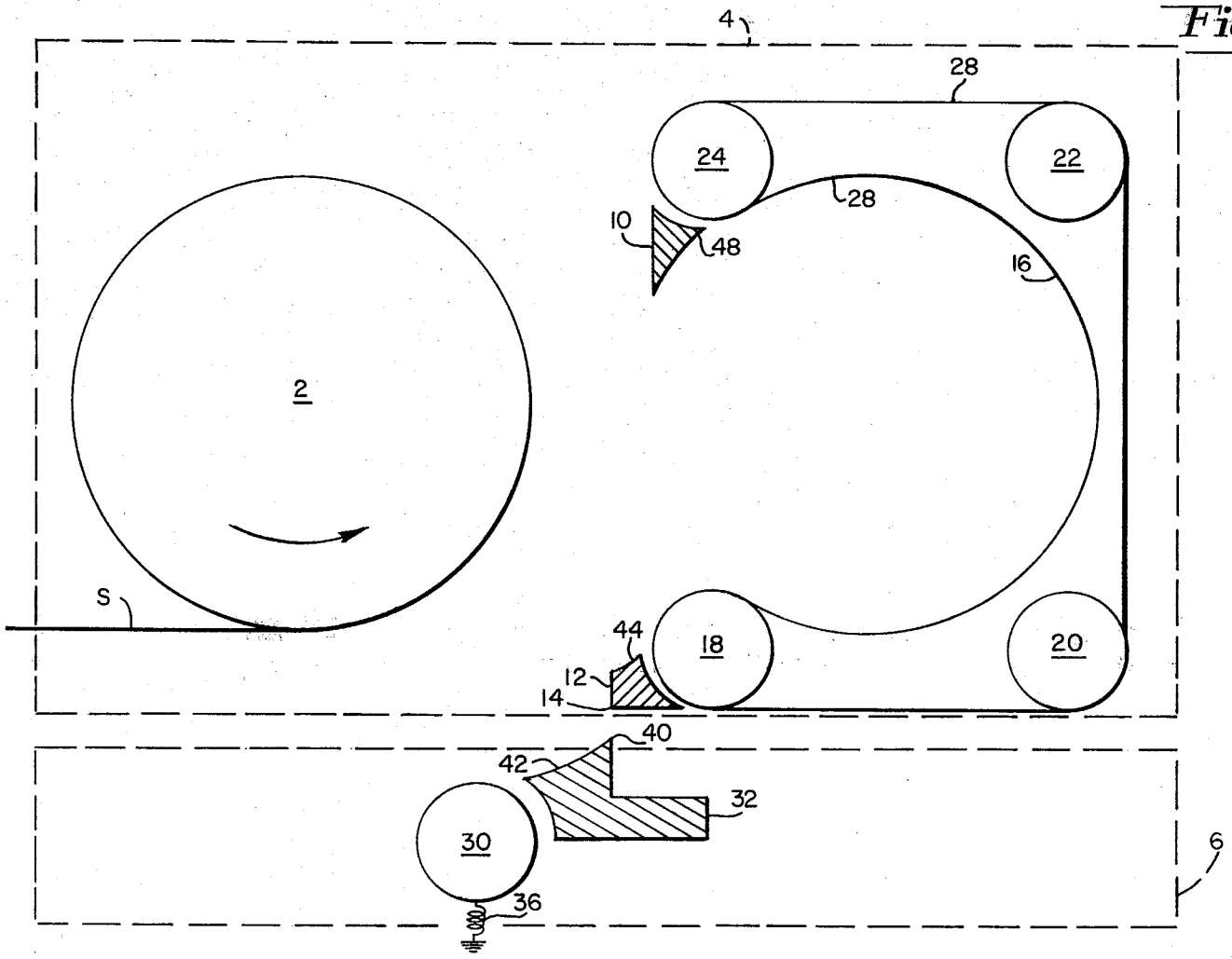
FIG. 3 is a schematic diagram of the apparatus of FIG. 1 in a non-shearing and non-coiling position.
Figure 4:
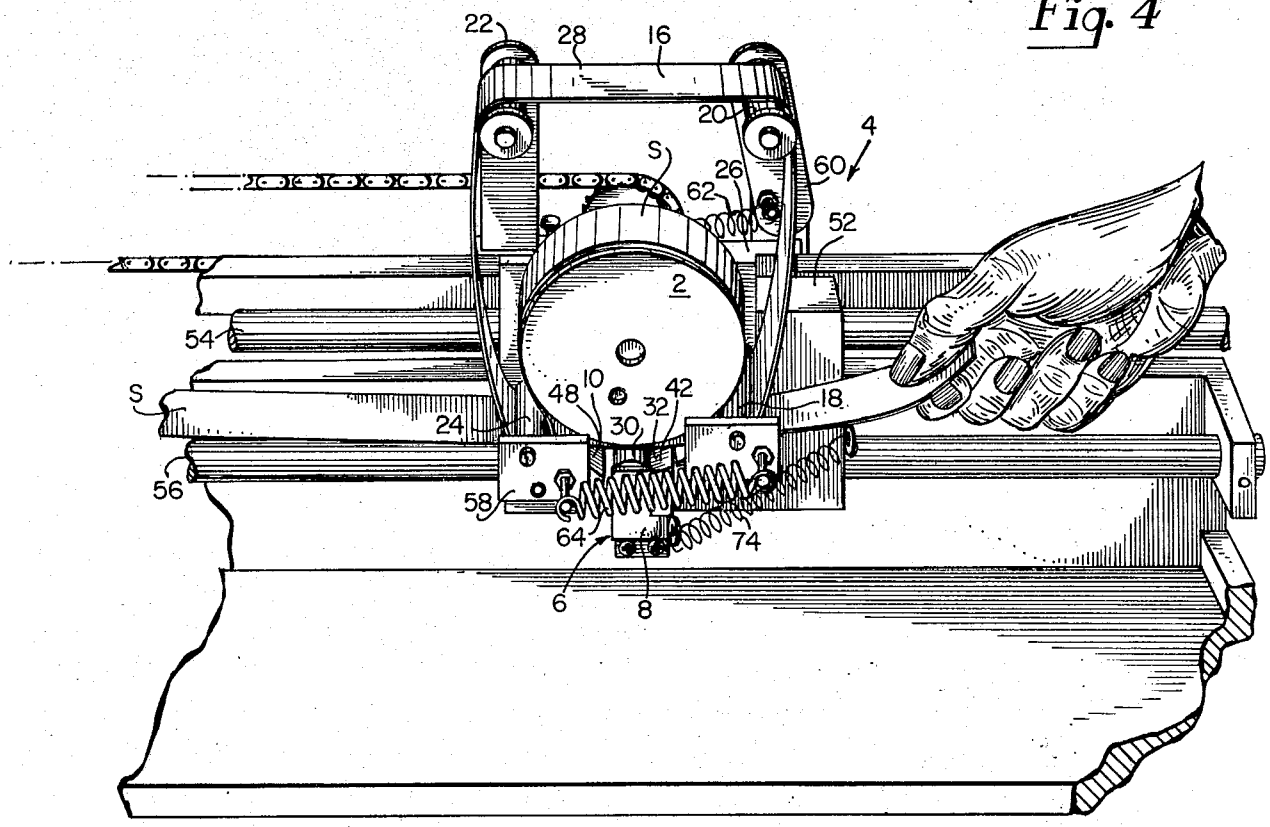
FIG. 4 is a perspective view of a preferred embodiment of the apparatus shown in the beginning of a coiling operation.
Figure 5:
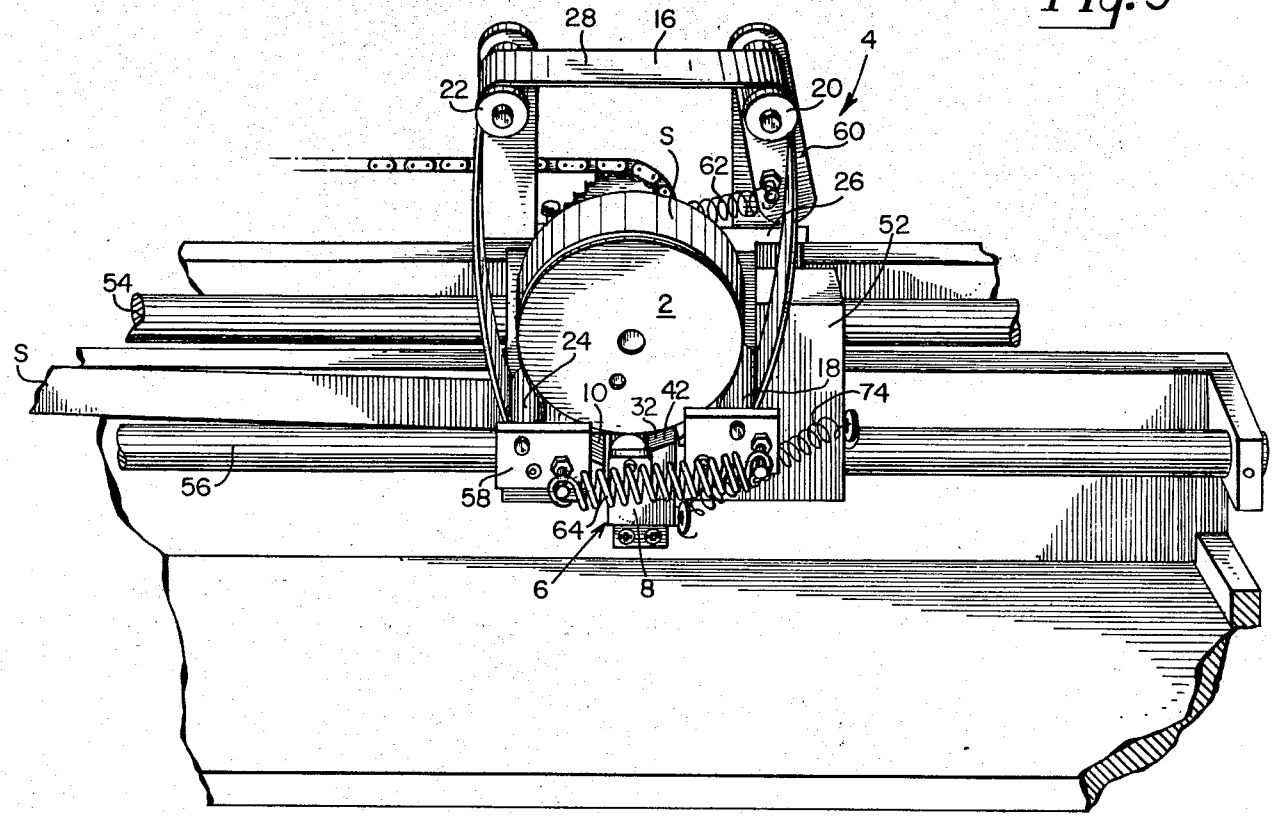
FIG. 5 is a perspective view of the apparatus shown in FIG. 4 shown in a coiling operation.
Figure 6:
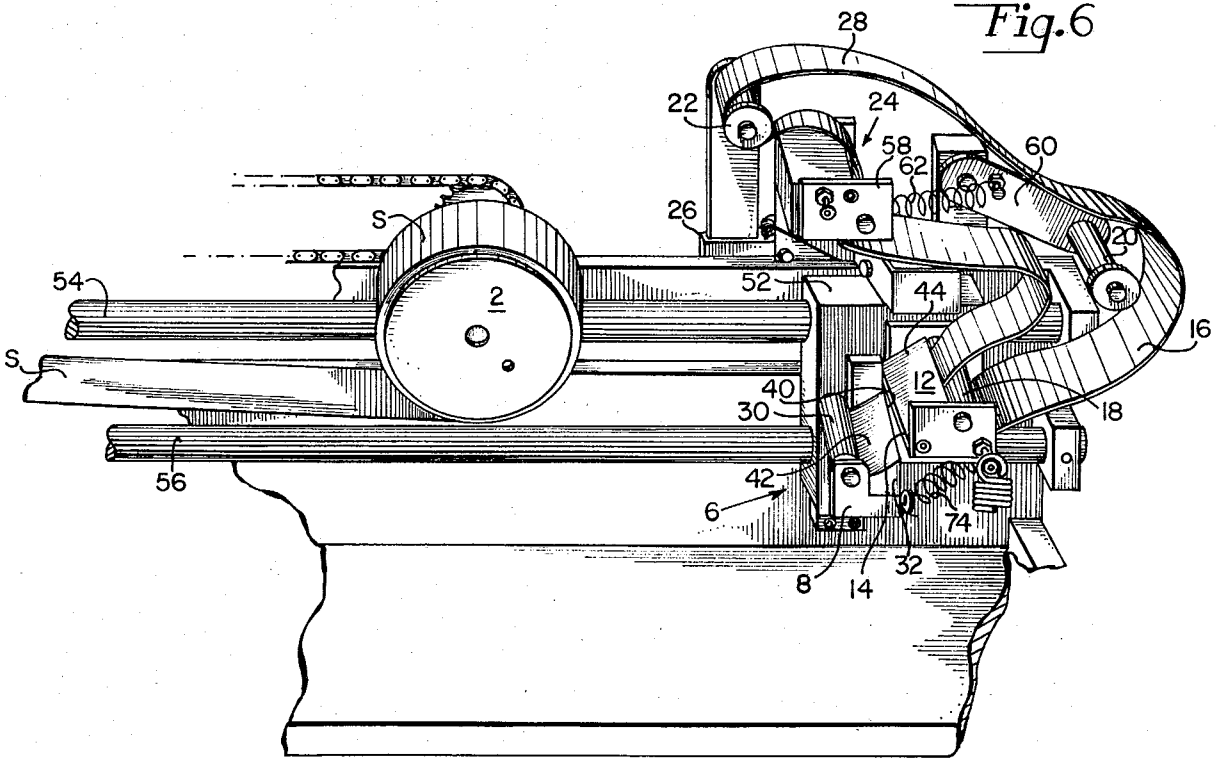
FIG. 6 is a perspective view of the apparatus shown in a non-shearing and non-coiling position.

After the remaining strip material S is wrapped several times around the mandrel 2, the apparatus is moved to a retracted position, away from the mandrel 2, as shown in FIGS. 3 and 6. The belt wrapper assembly 4 and the lower shear blade assembly 6 are attached to mounting means adapted to movement toward and away from the mandrel 2. The mounting means may comprise a block 52 slidably disposed on a pair of parallel rails 54, 56 located in close proximity to the mandrel 2, the rails providing support and a predetermined path over which the block 52 may be moved.

The first strip guide 10, the rollers 18, 20, 22, 24, and the cutting blades 12, 32 are mounted on the block 52. The first strip guide 10 and the roller 24 are attached to an arm 58 pivotally mounted on the block 52. The rollers 18 and 22 are fixedly attached to the block 52. Roller 24 is mounted on the pivotally movable arm 58, to a facilitate the movement of the assembly 4 between the advanced and retracted positions. The roller 20 is mounted on a pivotally movable arm 60 biased by a spring 62 to maintain belt tension when the wrapper assembly 4 is in the advanced position. The wrapper assembly 4 may be moved to the retracted position when the first strip guide 10 and the roller 24 are pivotally moved upwardly to a position close to the roller 22, as seen in FIG. 6. The block 52 is free to move along the rails 54, 56 toward and away from the mandrel 2 when the wrapper assembly 4 is in the retracted position. The wrapper assembly 4 may be advanced to a position for shearing and coiling the strip S by moving the block 52 along the rails 54, 56 to a proper position and positioning the roller 18 close to the mandrel 2. The first strip guide 10 and the roller 24 are pivotally moved so that the outside surface 28 of the belt 16 is wrapped in tension around the mandrel 2 with the roller 24 and first strip guide 10 on one side of the mandrel 2. A coil spring 64, detachably connected between the upper shear blade 12 and the pivot arm 58, may be used to provide sufficient bias force to keep the rollers 18, 24 in preferred positions close to the mandrel 2. The roller 20 is biased by the coil spring 62 to provide sufficient force to maintain the belt 16 in tension around the mandrel 2.

Figure 8:
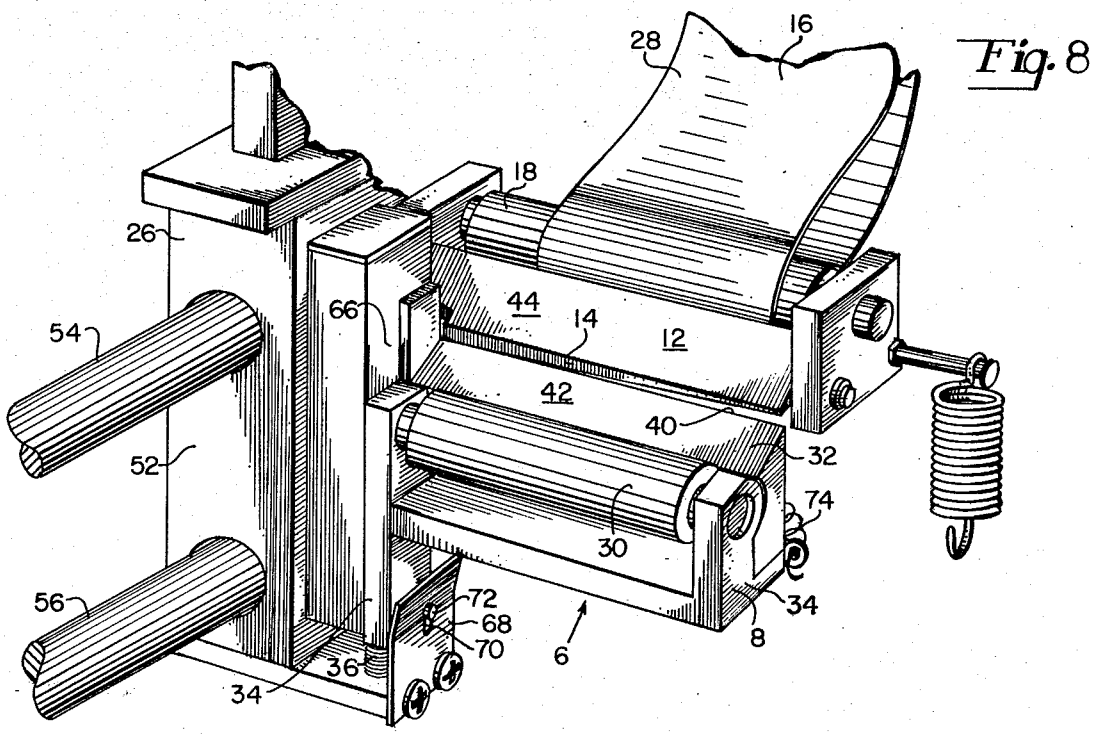
FIG. 8 is a detailed perspective view of a shear blade assembly portion of the apparatus.

Referring to FIG. 8, there is shown a more detailed view of the pinch drive roller 30 and the lower shear blade 32 disposed on the mounting 34 adapted to reciprocally move in a track 66 in response to a bias force provided by the spring 36. A leaf spring 68, has a slot 70 therein, in which is disposed a boss 72 extending from the mounting 34. The spring 68 may be bent back off the boss 72 to release the coil spring 36 from a compressed state, thereby generating a bias force directed against an end of the mounting 34 for simultaneously moving the attached pinch drive roller 30 and lower shear blade 32 upwardly. The upwardly moving pinch drive roller 30 compresses a moving section of strip material S against the uncovered surface 38 of the mandrel 2, while the cutting edge 40 of the simultaneously moving lower shear blade 32 slides past the cutting edge 14 of the upper shear blade 12, to shear the strip material S passing therebetween.

Figure 7:
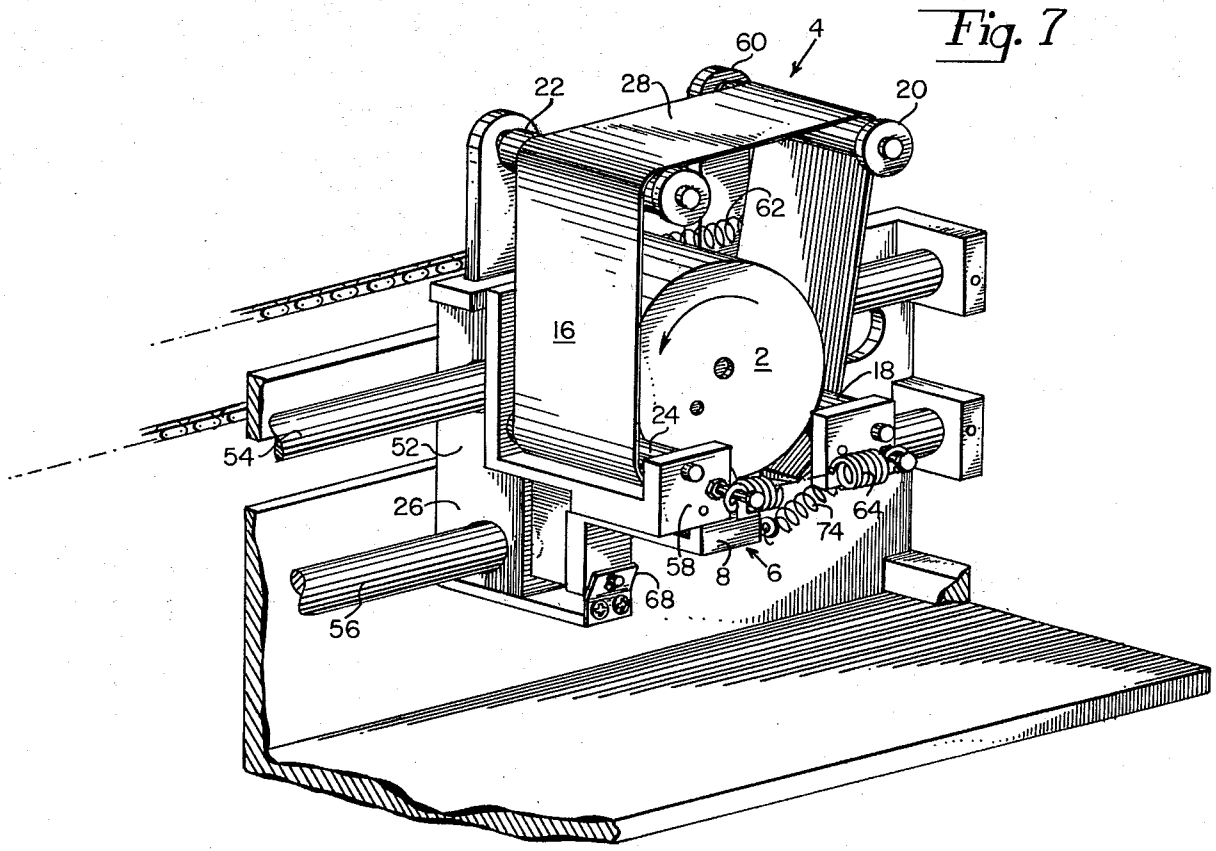
FIG. 7 is a perspective view of the apparatus.

An additional coil spring 74 (FIGS. 7 and 8), connected between an end of the lower shear blade 32 and the block 52 may be used to provide sufficient bias force to keep the shear blades 32, 12 in frictional contact to enhance the shearing action.

Surfaces 42, 44 of the shear blades 32, 14 normally in contact with the strip material S are curved similarly to the curvature of the mandrel 2 so that after shearing the strip material S, the combined surfaces 42, 44 form a second strip guide for guiding the remainder of the moving strip material between the moving outside belt surface 28 and the mandrel 2 rotatably driven by a motor (not shown). The pinch drive roller 30 serves as a lower shear blade stop for correctly forming the second strip guide while simultaneously compressing the strip material against an opposing coiler surface. A leading edge of the remaining strip material S is advanced the width of the upper shear blade 12 and pinched between the moving belt 16 and the rotating mandrel 2, whereby the strip material S is pulled around the mandrel 2 and between the curved surface 48 of the first strip guide 10, and similarly curved surface of the mandrel 2. After several turns of the strip material around the mandrel 2, the wrapping assembly 4 is moved to the retracted position and pulled along rails 54, 56 away from the mandrel 2 while the mandrel continues to rotate and wrap the strip material around itself.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. Apparatus for shearing and coiling strip material, said apparatus comprising a mandrel rotatable about its axis and adapted to receive said strip material on a peripheral portion thereof, first cutter means disposed proximate said mandrel in a fixed position, said first cutter means having a first guide surface thereon, and second cutter means having a first position further removed from said mandrel then said first cutter means, said second cutter means being movable to a second position adjacent said first cutter means to effect a cutting operation, said second cutter means having a second guide surface thereon, said first and second guide surfaces forming a substantially continuous entry surface when said second cutting means is in said second position, said entry surface being adapted to urge a cut end of said strip material into engagement with said peripheral portion of said mandrel.

2. The invention in accordance with claim 1 including mounting means for supporting an endless belt such that an outside surface of said belt is positioned adjacent a peripheral surface of said mandrel and is movable therewith, said apparatus being adapted to receive said strip material between said mandrel and said belt.

3. The invention in accordance with claim 2 in which said mounting means comprises roller means.

* * * * *